US005099288A

United States Patent [19]

Britto et al.

[11] Patent Number: 5,099,288

[45] Date of Patent: Mar. 24, 1992

[54] FIXING DEVICE WITH SELECTABLE FINISH

[75] Inventors: Ignatius L. Britto; Alexander D. Meade; Ashok Murthy; William F. Voit, Jr., all of Lexington, Ky.

[73] Assignee: Lexmark International, Inc., Greenwich, Conn.

[21] Appl. No.: 615,741

[22] Filed: Nov. 19, 1990

[51] Int. Cl.[5] ..... G03G 15/20

[52] U.S. Cl. ..... 355/290; 219/216; 355/285

[58] Field of Search ..... 219/216, 388; 355/208, 355/282, 285, 289, 290; 432/8, 13, 60, 228; 430/97, 98, 104, 124

[56] References Cited

U.S. PATENT DOCUMENTS

| | | | |
|---|---|---|---|
| 3,478,665 | 11/1969 | Umahashi et al. | 219/216 |
| 3,578,797 | 5/1971 | Hodges et al. | 432/9 |
| 3,965,331 | 6/1976 | Moser et al. | 219/216 |
| 4,242,566 | 12/1980 | Scribner | 219/216 |
| 4,332,457 | 6/1982 | Mitsuyama et al. | 355/295 X |
| 4,563,073 | 1/1986 | Reynolds | 219/216 X |
| 4,791,447 | 12/1988 | Jacobs | 219/216 X |
| 5,019,869 | 5/1991 | Patton | 355/290 |

FOREIGN PATENT DOCUMENTS

| | | |
|---|---|---|
| 0050160 | 2/1990 | Japan . |
| 0072383 | 3/1990 | Japan . |

*Primary Examiner*—A. T. Grimley
*Assistant Examiner*—Christopher Horgan
*Attorney, Agent, or Firm*—John A. Brady

[57] ABSTRACT

A document (7) carrying thermoplastic toner (46) to be fixed is held in the nip of belts (26 and 30) where it is moved under a heater (34). The toner is in contact with the longer of the two belts. When a slightly rough image is desired, such as in normal printing on paper, the document is removed while the toner is still mobile and has some affinity for the belt on which it is carried. When a very smooth image is desired, such as for transparencies to be optically projected, the document is removed after the toner is cooled.

6 Claims, 3 Drawing Sheets

FIXING DEVICE WITH SELECTABLE FINISH

DESCRIPTION

1. Technical Field

This invention relates to printers employing thermal fixing of finely divided, powder toners. Such printers are often electrostatic, but powder toners may be applied to paper, transparent foils, or other substrates using magnetic and other techniques. The toner, when applied for development, may be suspended in liquid or air, brushed on, or applied by other techniques. The powders are then coalesced with heat by passing the substrate between a roller and a support where it is heated. At the end of such fixing the toner has a surface texture (termed "finish") which may be smooth or rough, depending on the overall characteristics of the fixing operation.

2. Background of the Invention

A slightly rough finish on toner on ordinary paper is generally preferable since a smooth finish reflects light in a coherent manner (shines), which is distracting. A very smooth finish is necessary on a transparency which is to be optically projected since the rough finish scatters light transmitted through it and degrades the image projected, particularly multicolor images. Prior printer designs apparently have not been directed to this dichotomy. Various designs are known which roughen the texture of finished printing. Other designs, particularly, Hodges U.S. Pat. No. 3,578,797, cool the fixed image before removing the toner from contact with the surface on which it is cooled. Controlling the degree of cooling to control roughness, however, is not disclosed.

DISCLOSURE OF THE INVENTION

In an electrophotographic or other imaging system employing thermoplastic, powdered toner, a toned image is fixed in a system which permits selection of either glossy or non-glossy images. A belt fuser is used, and non-glossy images are obtained by removing the document from contact with its surface while the toner is still mobile. A glossy image is achieved by allowing the toner to cool further. This is implemented by having an alterable heat sink or, alternatively, multiple removal stations.

BRIEF DESCRIPTION OF THE DRAWING

The details of this invention will be described in connection with the accompanying drawing, in which.

BEST MODE FOR CARRYING OUT THE INVENTION

Figure 1:
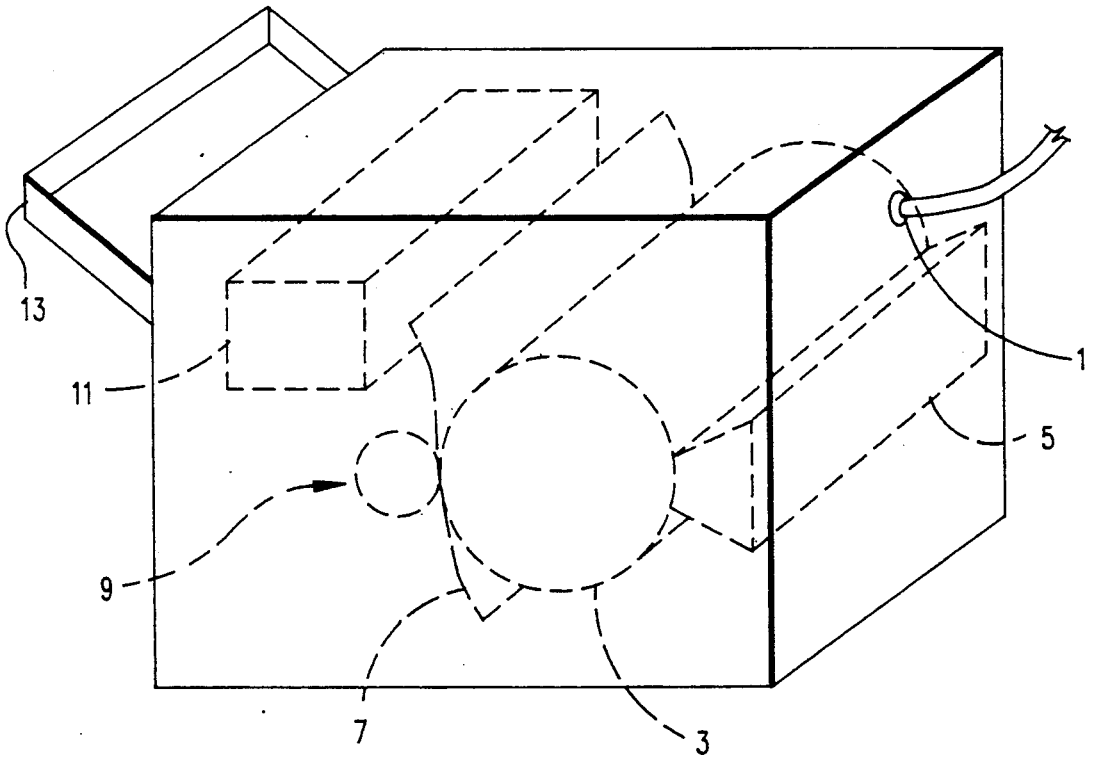
FIG. 1 is an illustrative drawing showing an imaging system or printer employing fixing of toner in accordance with this invention.

This invention is applicable to any imaging system in which a powder toner is applied to define the image and then fixed with heat. FIG. 1 illustrates such a system in the form of an electrostatic printer. Image information is received at input terminal 1. Such information typically is a sequence of character and spacing codes or data describing the entire page of a document to be printed in bit mapped form (each picture element or pel defined). This information is then applied optically to an electrostatically changed photoconductive surface 3, and the electrostatic image so formed is then developed with toner at toning station 5. The paper or other substrate 7 being printed upon is contacted with the toner image with pressure at a transfer station 9. Paper 7 then enters fixing station 11, after which paper 7 is stacked in output hopper or bin 13.

As just described, the imaging system is entirely conventional and therefore will not be discussed in further detail. In accordance with this invention, selection between glossy and non-glossy images is achieved in one alternative by the fixing station 11 comprising the apparatus of FIG. 2.

Figure 2:
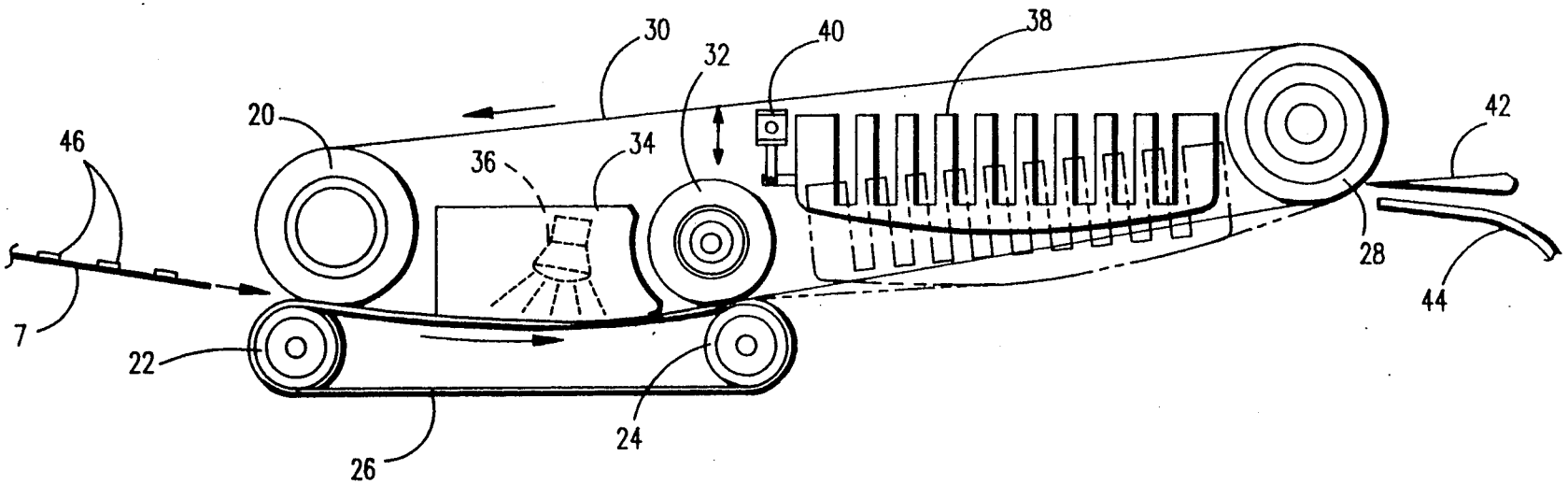
FIG. 2 shows one alternative fixing system in accordance with this invention.

In FIG. 2 the paper or other substrate 7 enters between drive roll 20 and an opposing idler roll 22. Spaced from idler roll 22 is a second idler roll 24, rolls 22 and 24 supporting an endless back-up belt 26 of silicone rubber. Positioned substantially past roll 24 is a second idler roll 28, rolls 20 and 28 supporting an endless, heat resistant fuser belt 30. Opposite roll 24 and contacting the fuser belt 30 is an idler, pinch roll 32.

Positioned between rolls 20 and 32 and in contact with fuser belt 30 is a metal heater block 34 having a broad area of contact with belt 30. Block 34 has an internal infrared lamp 36 as a heat source. Positioned between rolls 32 and 28 is a metal heat sink 38 (having a number of fins to facilitate heat dispersion as is conventional). As shown in solid line, heat sink 38 is not in contact with fuser belt 30 and therefore contributes little to cooling a substrate 7. As shown in dotted line, however, heat sink 38 is in broad contact with belt 30, and thus considerably increases cooling of substrate 7 on belt 30. Heat sink 38 may be moved between the two positions in any convenient manner, movement controller 40 being shown as a solenoid for purposes of illustration.

A deflection finger 42 is positioned at roll 28 in slight contact or close proximity with belt 30 to direct substrate 7 in a guide 44 which directs substrate 7 to output bin 13.

In operation the document substrate 7 carrying toner 46 as a loose powder is fed between belts 26 and 30 with toner 46 facing belt 30 where it is firmly grasped between the nip of belt 26 and belt 30. Belts 26 and 30 are driven by drive roll 20 through their friction contact and therefore move at the same speed. Document 7 is moved under block 34 where the heat from block 34 is sufficient to melt or at least flow together toner 46 of document 7. Document 7 continues to move past the location of rolls 24 and 32. When a rough or matte surface is desired for low gloss, movement controller 40 is employed to have heat sink 34 away from belt 30 and finger 42 deflects document 7 from belt 30 while the toner still has some mobility. Since the toner has some affinity for belt 30, the resulting surface is rough.

When a smooth surface is desired for high gloss, movement controller 40 is employed to have heat sink 38 in broad contact with belt 30. Finger 42 then deflects document 7 from belt 30 after the toner is so cool as to have no mobility or sufficient affinity to belt 30 to affect the surface of the toner. The resulting surface is smooth.

Figure 3:
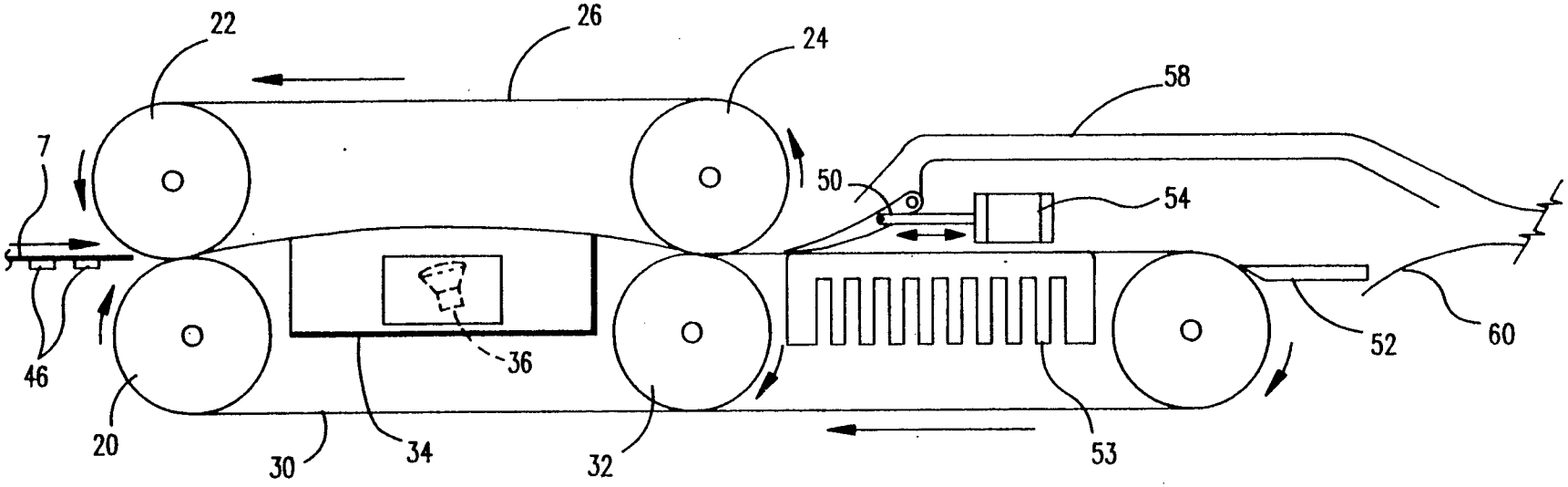
FIG. 3 shows a second alternative fixing system in accordance with this invention.

FIG. 3 illustrates an alternative apparatus to that of FIG. 2, which employs two deflection fingers 50 and 52, one of which is selectable by a movement controller 54, shown illustratively as a solenoid. Elements corresponding directly with those of FIG. 2 are given the same reference numeral as in FIG. 2. A heat sink 53 is located in the position corresponding to sink 34 of FIG.

2, but sink 53 is stationary and functions only to permit a more compact design. Deflection finger 50 is positioned substantially closer to heater block 34 than finger 52. Finger 50 deflects document 7 into a guide path 58, which leads ultimately to bin 13. Documents 7 deflected by finger 52 are directed also to bin 13 through guide 60, which merges with guide path 58.

In operation of the apparatus of FIG. 3, when a matte surface is desired, movement controller 54 positions finger 50 into engagement with belt 30. A document 7, being moved continuously by belt 30 as described with respect to FIG. 2, has not fully cooled and therefore becomes rough when directed by finger 50. When a smooth document is desired, movement controller 54 positions finger 50 away from belt 30. A document 7 then moves a sufficient time with belt 30 for its toner to have cooled and have insufficient affinity for belt 30 to result in roughness when deflected by finger 52.

Thus, by selection of two cooling modes as described with respect to FIG. 2 and FIG. 3, a glossy or matte document may be obtained as desired. A glossy document is particularly important when it is a color transparency, since a rough transparency scatters the light. As is conventional, the belts 30 and 26 would be continuously cleaned by felt pads or the like mounted in contact with each belt 30 and 26. Variations and improvements within the spirit and scope of this invention can be anticipated.

We claim:

1. An imaging system comprising imaging means to produce variable images on a document substrate as a thermoplastic powder and a fixing station to fix said images on said substrate comprising heating means to continuously contact said images on said substrate while heating said substrate, and means to select one status in which said substrate is removed from contact with said heating means while said toner is at a temperature at which said toner is roughened by affinity to said heating means and to select a second status in which said substrate is removed from contact with said heating means when said toner is at a lower temperature and is not roughened.

2. The imaging system as in claim 1 in which said means to select comprises a moveable heat sink.

3. The imaging system as in claim 1 in which said means to select comprises first and second deflection means to direct said substrate from said contact, said first deflection means being moveable into a position in which said document is removed when said toner is at the temperature of said one status and being moveable into a position in which said document is not removed, and said second deflection means being positioned to remove said document when said toner is at the temperature of said second status.

4. An imaging system comprising means to produce variable images on a document substrate as a thermoplastic powder, a first endless belt and a second endless belt forming a nip to receive said document and heat said thermoplastic powder to flow said powder together for coalescence with said thermoplastic powder in contact with said first belt, said first belt being longer than said second belt, and means to select one status in which said document is removed from said first belt while said toner is at a temperature at which said toner is roughened by affinity to said first belt and to select a second status in which said document is removed from said first belt when said toner is at a lower temperature and is not roughened.

5. The imaging system as in claim 4 in which said means to select comprises a moveable heat sink.

6. The imaging system as in claim 4 in which said means to select comprises first and second deflection means to direct said substrate from said first belt, said first deflection means being moveable into a position in which said document is removed when said toner is at the temperature of said one status and being moveable into a position in which said document is not removed, and said second deflection means being positioned to remove said document when said toner is at the temperature of said second status.

* * * * *